US009201317B2

(12) United States Patent
Yamashita et al.

(10) Patent No.: US 9,201,317 B2
(45) Date of Patent: Dec. 1, 2015

(54) CONDUCTIVE SUPPORT FOR ELECTROPHOTOGRAPHIC PHOTORECEPTOR, ELECTROPHOTOGRAPHIC PHOTORECEPTOR, IMAGE FORMING APPARATUS, AND PROCESS CARTRIDGE

(71) Applicant: FUJI XEROX CO., LTD., Tokyo (JP)

(72) Inventors: Takayuki Yamashita, Kanagawa (JP); Yoshifumi Shoji, Kanagawa (JP); Yuko Yamano, Kanagawa (JP); Masaru Agatsuma, Kanagawa (JP); Shinya Yamamoto, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 13/837,076

(22) Filed: Mar. 15, 2013

(65) Prior Publication Data

US 2014/0044456 A1 Feb. 13, 2014

(30) Foreign Application Priority Data

Aug. 10, 2012 (JP) ..... 2012-179073

(51) Int. Cl.

| | |
|---|---|
| ***G03G 15/00*** | (2006.01) |
| ***G03G 5/043*** | (2006.01) |
| ***G03G 5/10*** | (2006.01) |

(52) U.S. Cl.

CPC ..... *G03G 5/0436* (2013.01); *G03G 5/10* (2013.01); *G03G 5/102* (2013.01); *G03G 15/751* (2013.01)

(58) Field of Classification Search

CPC . G03G 15/751; G03G 5/14704; G03G 15/75; G03G 5/0436; G03G 5/102

USPC ..... 399/159

See application file for complete search history.

(56) References Cited

U.S. PATENT DOCUMENTS

| | | | | |
|---|---|---|---|---|
| 2004/0098855 | A1* | 5/2004 | Sakuma et al. | 29/527.4 |
| 2007/0110488 | A1* | 5/2007 | Kabata et al. | 399/351 |
| 2007/0264042 | A1* | 11/2007 | Mori | 399/106 |
| 2010/0172792 | A1* | 7/2010 | Gejima et al. | 420/540 |

FOREIGN PATENT DOCUMENTS

| | | |
|---|---|---|
| JP | A-61-044148 | 3/1986 |

* cited by examiner

*Primary Examiner* — David Bolduc
*Assistant Examiner* — Barnabas Fekete
(74) *Attorney, Agent, or Firm* — Oliff PLC

(57) ABSTRACT

A conductive support for an electrophotographic photoreceptor contains aluminum, in which the conductive support has a Young's modulus of from 32,000 MPa to 55,000 MPa.

16 Claims, 10 Drawing Sheets

CONDUCTIVE SUPPORT FOR ELECTROPHOTOGRAPHIC PHOTORECEPTOR, ELECTROPHOTOGRAPHIC PHOTORECEPTOR, IMAGE FORMING APPARATUS, AND PROCESS CARTRIDGE

CROSS-REFERENCE TO RELATED APPLICATIONS

This application is based on and claims priority under 35 USC 119 from Japanese Patent Application No. 2012-179073 filed Aug. 10, 2012.

BACKGROUND

1. Technical Field

The present invention relates to a conductive support for an electrophotographic photoreceptor, an electrophotographic photoreceptor, an image forming apparatus, and a process cartridge.

2. Related Art

In the related art, as an electrophotographic image forming apparatus, an apparatus which uses an electrophotographic photoreceptor (hereinafter, also referred to as a "photoreceptor") to sequentially perform, for example, charging, exposure, developing, transfer, and cleaning steps is widely known.

As an electrophotographic photoreceptor, there are widely known a function separation type photoreceptor in which a charge generation layer which generates charge through exposure and a charge transport layer which transports charge are laminated on a conductive support such as aluminum; and a single-layer type photoreceptor in which a single layer has a function of generating charge as well as a function of transporting charge.

SUMMARY

According to an aspect of the invention, there is provided a conductive support for an electrophotographic photoreceptor, the conductive support containing aluminum, in which a Young's modulus is from 32,000 MPa to 55,000 MPa.

BRIEF DESCRIPTION OF THE DRAWINGS

Exemplary embodiments of the present invention will be described in detail based on the following figures, wherein.

DETAILED DESCRIPTION

Figure 1:
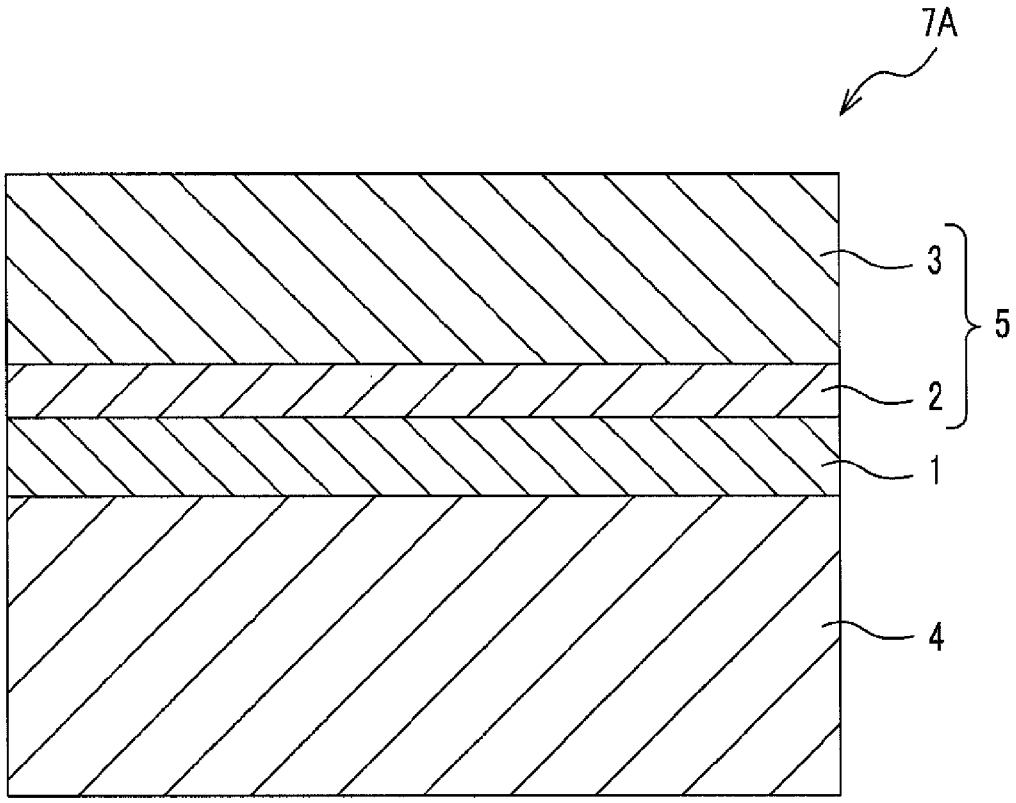
FIG. 1 is a partial cross-sectional view schematically illustrating a configuration example of an electrophotographic photoreceptor according to an exemplary embodiment of the invention.

Hereinafter, exemplary embodiments of the invention will be described with reference to the accompanying drawings. In the drawings, components having the same function are represented by the same reference numeral, and the descriptions thereof will not be repeated.

Conductive Support for Electrophotographic Photoreceptor

A conductive support for an electrophotographic photoreceptor (also simply referred to as a "conductive support") according to an exemplary embodiment of the invention contains aluminum and a Young's modulus thereof is from 32,000 MPa to 55,000 MPa.

In the conductive support according to the exemplary embodiment, permanent deformation due to external impact is suppressed. The reason is considered to be as follows.

In a general conductive support used for an electrophotographic photoreceptor, a material having high hardness and superior processability is selected in order to improve precision. In this case, respective physical properties such as Young's modulus are used to improve precision. The Young's modulus of a conductive support is usually set to be within a range of from 60,000 MPa to 90,000 MPa.

However, when a high-hardness aluminum alloy for high precision is used for a conductive support to prepare an electrophotographic photoreceptor, the conductive support may be deformed due to its high hardness by impact of another member in contact with the photoreceptor, for example, caused by a fall during transportation. In addition, similarly, from the viewpoint of maintaining strength, it is difficult to reduce the thickness of a conductive support and to reduce the amount of used aluminum.

On the other hand, the conductive support according to the exemplary embodiment contains aluminum or an aluminum alloy so as to have high hardness, and a Young's modulus thereof is from 32,000 MPa to 55,000 MPa. Therefore, it is considered that, when a member in contact with a photoreceptor receives an impact by a fall or the like, elastic deformation is likely to occur and permanent deformation (plastic deformation) is suppressed.

Electrophotographic Photoreceptor

An electrophotographic photoreceptor according to an exemplary embodiment of the invention includes the conductive support according to the exemplary embodiment; and a photosensitive layer that is arranged on the conductive support.

FIG. 1 is a cross-sectional view schematically illustrating a layer configuration example of an electrophotographic photoreceptor 7A according to an exemplary embodiment of the invention. The electrophotographic photoreceptor 7A illustrated in FIG. 1 includes a structure in which an undercoat layer 1, a charge generation layer 2, and a charge transport layer 3 are laminated in this order on the conductive support 4. In this case, the charge generation layer 2 and the charge transport layer 3 constitute a photosensitive layer 5.

FIGS. 2 to 5 are cross-sectional views schematically illustrating other layer configuration examples of the electrophotographic photoreceptor according to the exemplary embodiment.

Figure 2:
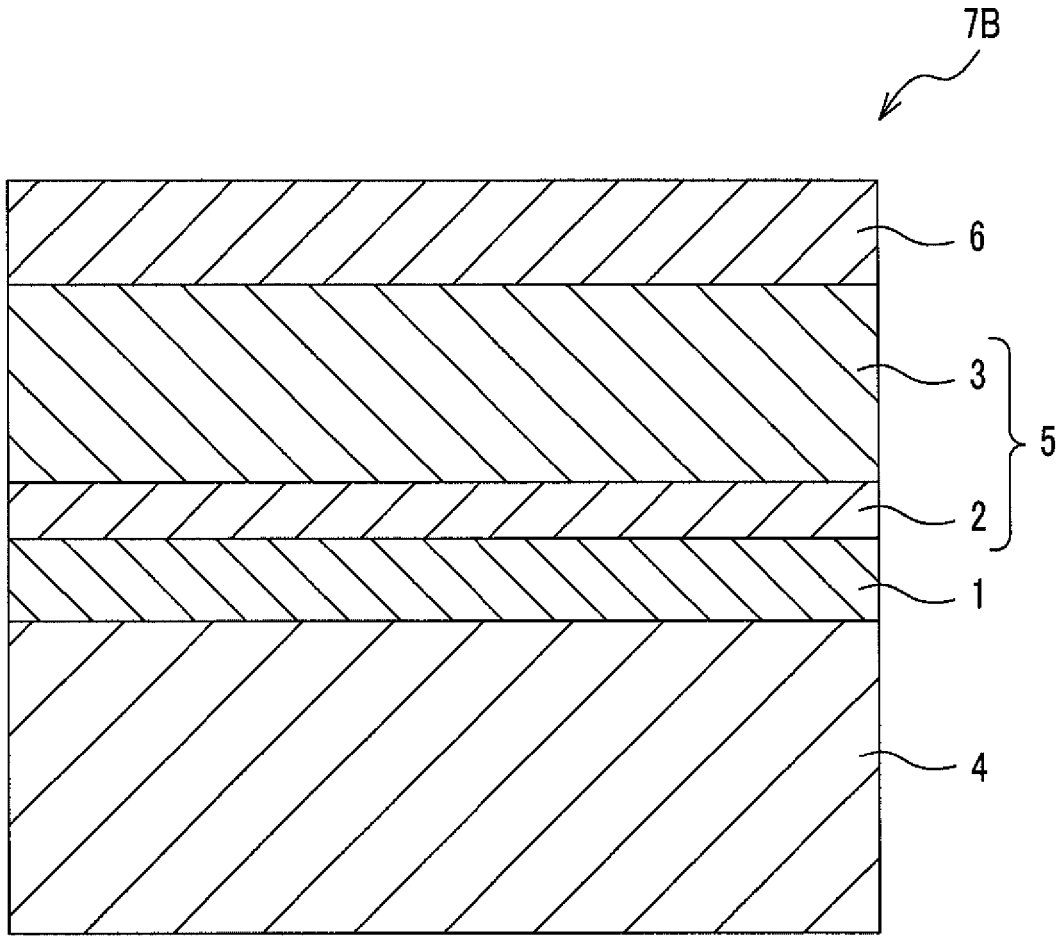
FIG. 2 is a partial cross-sectional view schematically illustrating another configuration example of the electrophotographic photoreceptor according to the exemplary embodiment.
Figure 3:
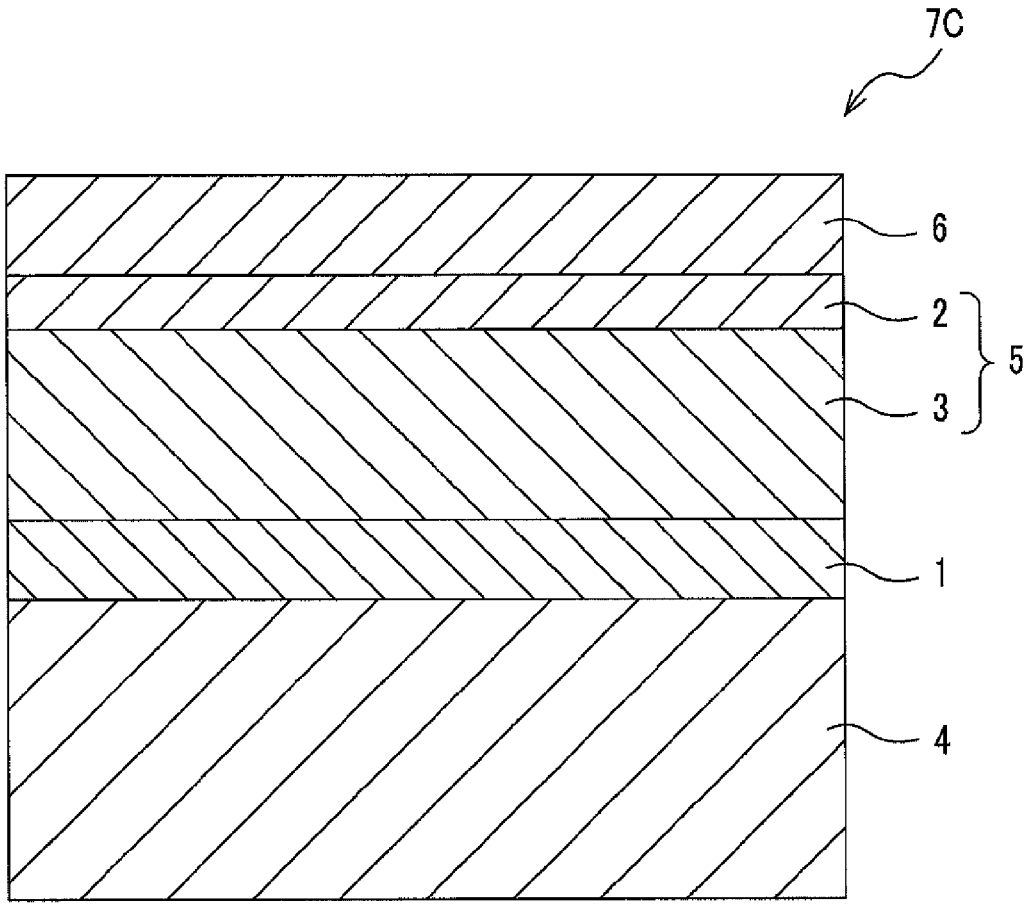
FIG. 3 is a partial cross-sectional view schematically illustrating another configuration example of the electrophotographic photoreceptor according to the exemplary embodiment.

Electrophotographic photoreceptors 7B and 7C illustrated in FIGS. 2 and 3 include the photosensitive layer in which the charge generation layer 2 and the charge transport layer 3 have separate functions similarly to the case of the electrophotographic photoreceptor 7A illustrated in FIG. 1, and a protective layer 6 is formed as the outermost layer. The electrophotographic photoreceptor 7B illustrated in FIG. 2 has a structure in which the undercoat layer 1, the charge generation layer 2, the charge transport layer 3, and the protective layer 6 are sequentially laminated on the conductive support 4. The electrophotographic photoreceptor 70 illustrated in FIG. 3 has a structure in which the undercoat layer 1, the charge transport layer 3, the charge generation layer 2, and the protective layer 6 are sequentially laminated on the conductive support 4.

Figure 4:
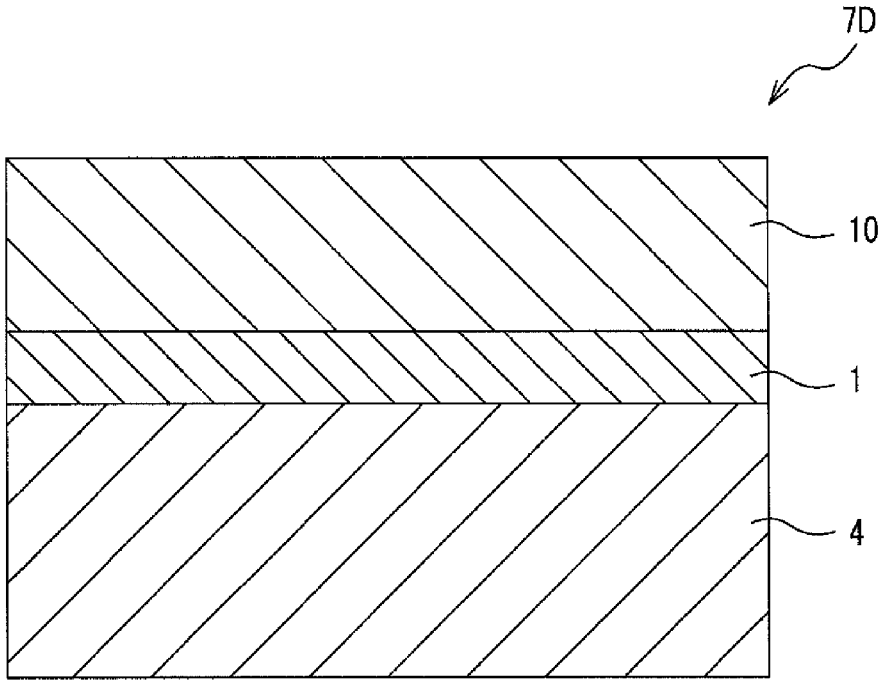
FIG. 4 is a partial cross-sectional view schematically illustrating another configuration example of the electrophotographic photoreceptor according to the exemplary embodiment.
Figure 5:
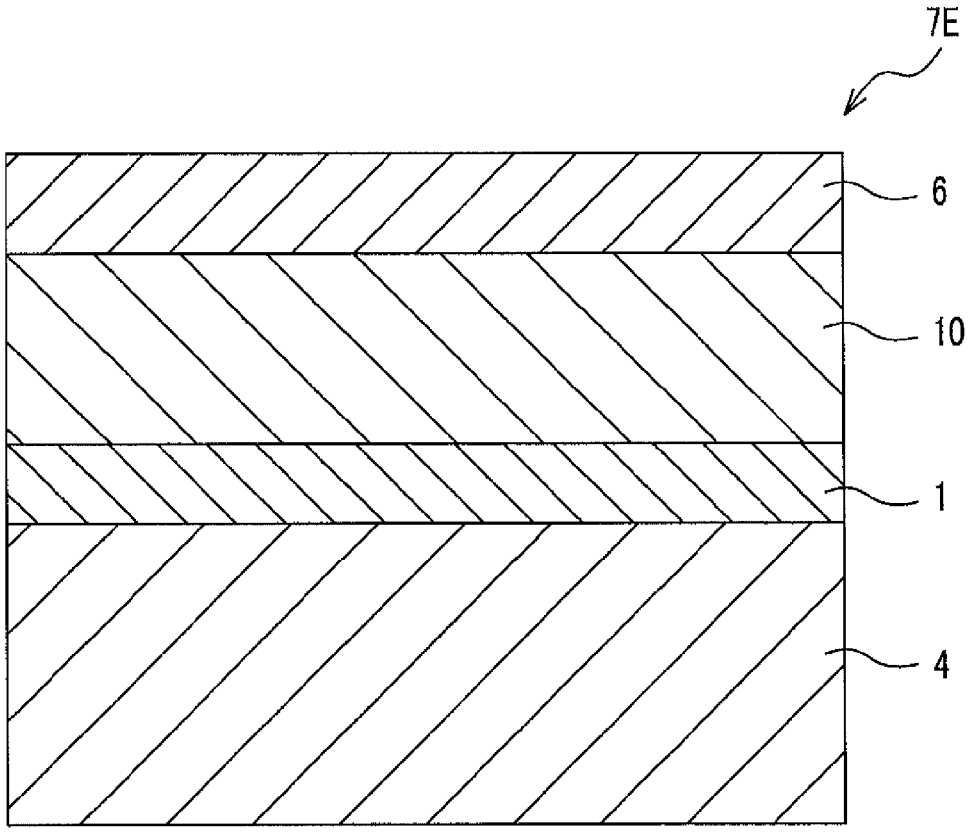
FIG. 5 is a partial cross-sectional view schematically illustrating another configuration example of the electrophotographic photoreceptor according to the exemplary embodiment.

On the other hand, in electrophotographic photoreceptors 70 and 7E illustrated in FIGS. 4 and 5, a single layer (single-layer type photosensitive layer 10) contains a charge generation material and a charge transport material and functions are integrated. The electrophotographic photoreceptor 70 illustrated in FIG. 4 has a structure in which the undercoat layer 1 and the single-layer type photosensitive layer 10 are sequentially laminated on the conductive support 4. The electrophotographic photoreceptor 7E illustrated in FIG. 5 has a structure in which the undercoat layer 1, the single-layer type photosensitive layer 10, and the protective layer 6 are sequentially laminated on the conductive support 4.

In the respective electrophotographic photoreceptors 7A to 7E, the undercoat layer 1 is not necessarily provided.

Hereinafter, the respective components will be described based on the electrophotographic photoreceptor 7B illustrated in FIG. 2. In the following description, the electrophotographic photoreceptor 7B will also be collectively called the electrophotographic photoreceptor 7 when the description is applied to all the electrophotographic photoreceptors 7B to 7E illustrated in FIGS. 2 to 5.

Conductive Support

The conductive support 4 is formed of a metal containing aluminum (aluminum or an aluminum alloy), and a Young's modulus thereof is 32,000 MPa to 55,000 MPa. "Conductive" described herein represents a volume resistivity being less than $10^{13}$ Ωcm.

Examples of the aluminum alloy forming the conductive support 4 include aluminum alloys containing aluminum and Si, Fe, Cu, Mn, Mg, Cr, Zn, or Ti.

It is preferable that the aluminum alloy forming the conductive support 4 is so-called 1000 series alloy. From the viewpoint of processability, the content (weight ratio) of aluminum is preferably higher than or equal to 99.5% and more preferably higher than or equal to 99.7%.

The Young's modulus is a numerical value indicating the degree to which a material is deformed when a force is applied thereto. In the exemplary embodiment, a value is measured using a tensile tester (manufactured by Shimadzu Corporation; AUTOGRAPH) in a tension test. The Young's modulus of the conductive support 4 according to the exemplary embodiment is from 32,000 MPa to 55,000 MPa, preferably from 34,000 MPa to 53,000 MPa, and more preferably from 36,000 MPa to 51,000 MPa.

The Young's modulus is controlled by a process method and a treatment after a process.

A method of manufacturing the conductive support 4 according to the exemplary embodiment is not particularly limited. However, shape-forming processes of impact pressing, swaging, ironing, and the like may reduce a Young's modulus as compared to a drawing process of the related art. For example, the Young's modulus is adjusted to a range of from 32,000 MPa to 55,000 MPa by combining processes of impact pressing and ironing.

Figure 6C:
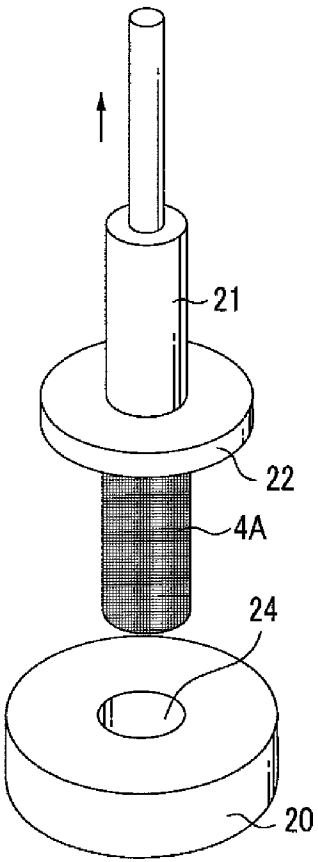
FIGS. 6A to 6C are diagrams schematically illustrating a part (impact pressing) of steps of manufacturing a conductive support according to an exemplary embodiment of the invention.
Figure 6B:
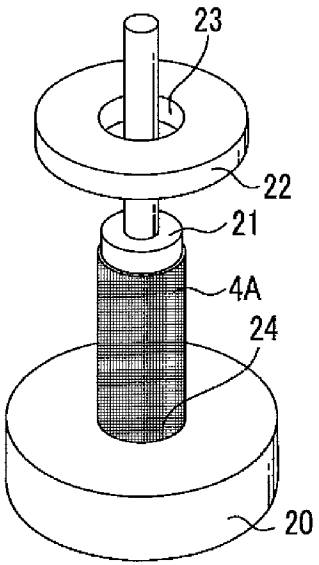
Figure 6A:
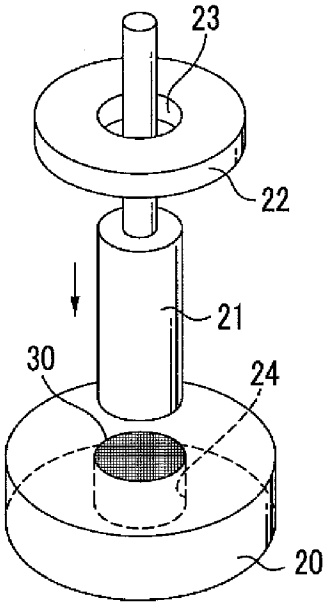
Figure 7B:
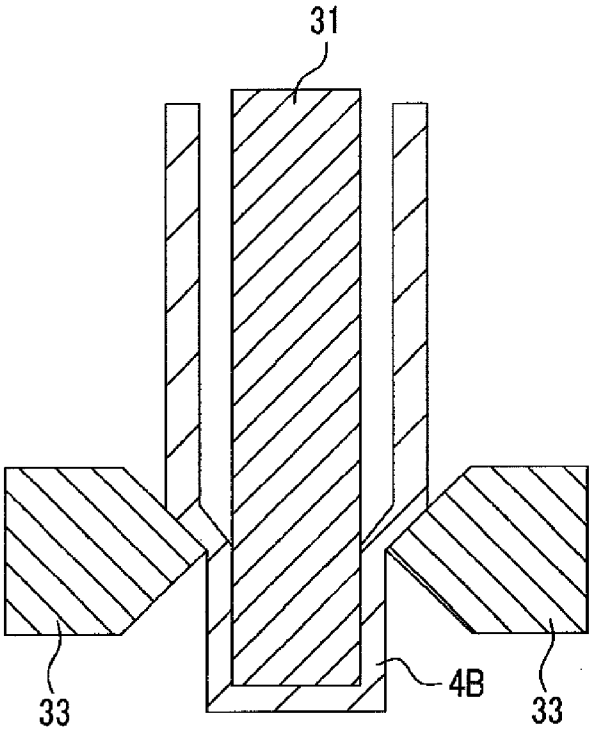
FIGS. 7A and 7B are diagrams schematically illustrating a part (swaging and ironing) of steps of manufacturing a conductive support according to an exemplary embodiment of the invention.
Figure 7A:
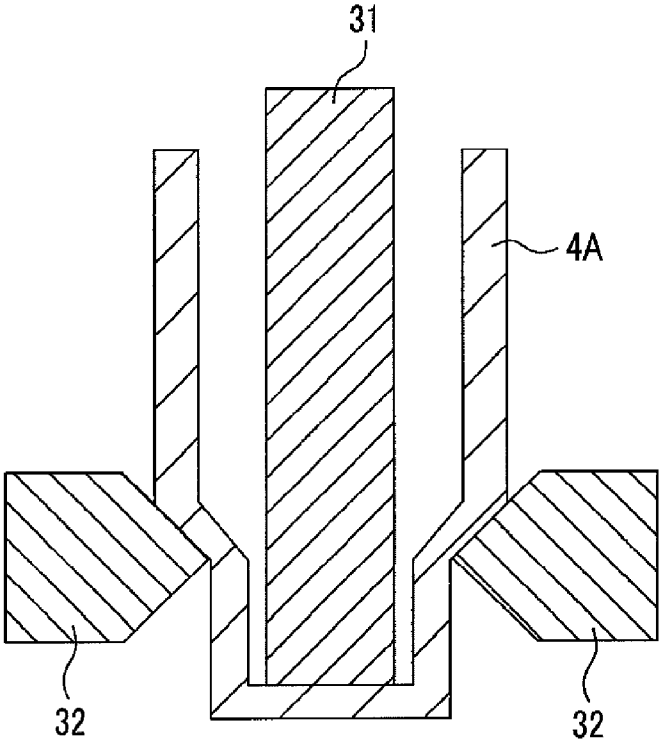

FIGS. 6A to 6C are diagrams schematically illustrating an example of a step in which a workpiece formed of aluminum or an aluminum alloy (hereinafter, also referred to as "a slag") is molded into a cylindrical compact by impact pressing; and FIGS. 7A and 7B are diagrams illustrating an example of a step in which an outer peripheral surface of the cylindrical compact molded by impact pressing is ironed to manufacture the conductive support 4 according to the exemplary embodiment.

Impact Pressing Process

First, a slag 30 formed of aluminum or an aluminum alloy, which is coated with a lubricant, is prepared; and, as illustrated in FIG. 6A, is set in a circular hole 24 which is provided in a die (female) 20. Next, as illustrated in FIG. 6B, the slag 30 set in the die 20 is pressed by a cylindrical punch (male) 21. As a result, the slag 30 is stretched and molded from the circular hole of the die 20 so as to cover the periphery of the punch 21. After molding, as illustrated in FIG. 6C, the punch 21 is pulled up and is caused to pass through a central hole 23 of a stripper 22. As a result, the punch 21 is removed and a cylindrical compact 4A is obtained.

Through such an impact pressing process, the hardness is improved by work hardening and thus the cylindrical compact 4A which has a thin thickness and high hardness and is formed of aluminum or an aluminum alloy is manufactured.

The thickness of the compact 4A is not particularly limited. However, from the viewpoints of maintaining the hardness as the conductive support for an electrophotographic photoreceptor and of obtaining a thickness of, for example, from 0.3 mm to 0.9 mm in the subsequent ironing process, the thickness of the compact 4A molded in the impact pressing process is preferably from 0.4 mm to 0.8 mm and more preferably from 0.4 mm to 0.6 mm.

Ironing Process

Next, as illustrated in FIG. 7A, optionally, the cylindrical compact 9A molded in the impact pressing process is pressed into a die 32 by a cylindrical punch 31 in the inside and swaged to reduce a diameter thereof; and then, is pressed into a die 33 having a smaller diameter and ironed, as illustrated in FIG. 7B.

The compact 9A may be ironed without swaging, or may be ironed through multiple steps. The thickness and the Young's modulus of the compact 43 are controlled according to the number of the ironing process.

In addition, the compact may be annealed before being ironed to release the stress.

The thickness of the ironed compact 4B is preferably from 0.3 mm to 0.9 mm and more preferably from 0.4 mm to 0.6 mm, from the viewpoints of maintaining the hardness as the conductive support for an electrophotographic photoreceptor and of obtaining a Young's modulus of from 32,000 MPa to 55,000 MPa.

In this way, the compact 4A molded in the impact pressing process is ironed. As a result, the conductive support 4 which has a thin thickness, a light weight, high hardness, and a Young's modulus of from 32,000 MPa to 55,000 MPa is obtained.

Figure 10:
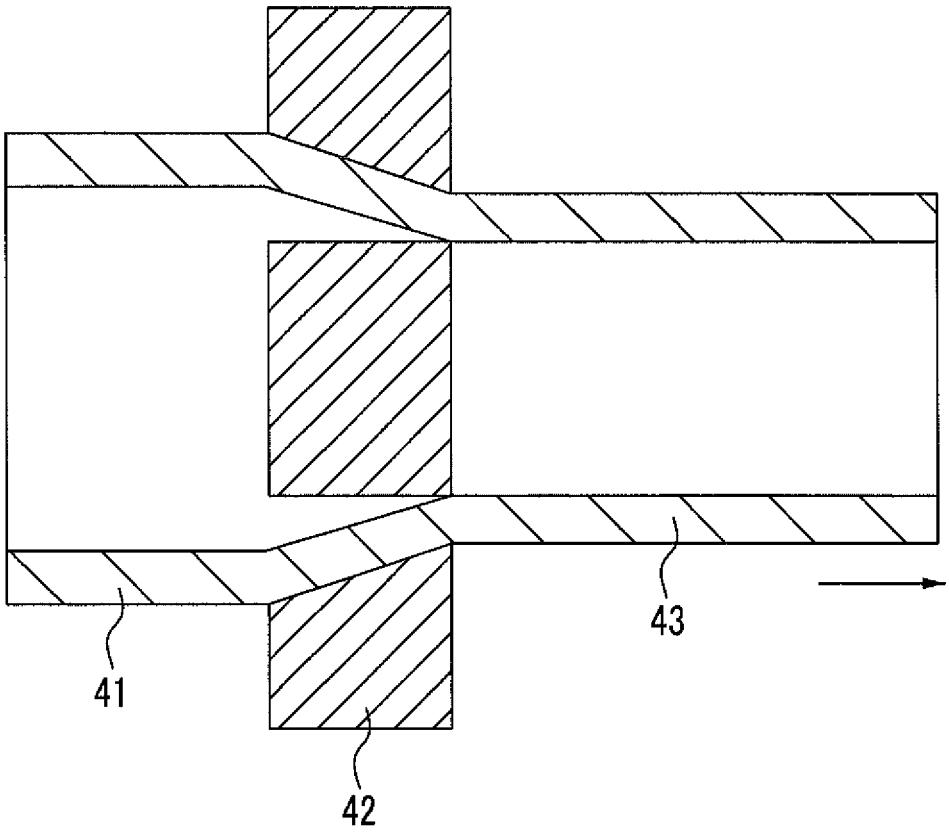
FIG. 10 is a diagram schematically illustrating an example of a step in which a conductive support is molded by drawing.

Examples of a heat treatment after the processes include annealing. For example, as illustrated in FIG. 10, an ingot 41 formed of an aluminum alloy is drawn through a die 42 to mold a cylindrical drawn pipe 43, followed by annealing at a temperature exceeding 150° C. for a long time. As a result, the Young's modulus may be reduced.

In addition, the Young's modulus may be adjusted by performing a process of, for example, annealing for homogenizing a non-processed slag or an ingot as preprocessing.

When the electrophotographic photoreceptor 7 is used for a laser printer, a laser having an oscillation wavelength of from 350 nm to 850 nm is preferable. It is preferable that a laser have a shorter wavelength from the viewpoint of superior resolution. In order to prevent interference fringes caused when laser light is emitted, it is preferable that a surface of the conductive support 4 be roughened so as to have a center line average roughness Ra of from 0.04 μm to 0.5 μm. When Ra is greater than or equal to 0.04 gym, an effect of preventing interference is obtained. On the other hand, when Ra is less than or equal to 0.5 μm, the roughening of image quality may be effectively suppressed.

When a light source which emits incoherent light is used, roughening for preventing interference fringes is not particularly necessary and this light source is preferable from the viewpoints of increasing lifetime because defects, caused by convex and concave portions of a surface of the conductive support 4, are prevented.

Examples of a roughening method include a wet honing process of spraying an aqueous solution, obtained by suspending an abrasive in water, onto a support; a centerless grinding process of pressing a support against a rotating grindstone to be continuously grinded; an anodization process; and a method of forming a layer containing organic or inorganic semi-conductive fine particles.

In the anodization process, anodization is performed in an electrolytic solution by using aluminum as an anode to form an oxidized film on an aluminum surface. Examples of the electrolytic solution include a sulfuric acid solution and an oxalic acid solution. However, after the process, a porous anodic oxide film is still chemically active, is easily contaminated, and has a large resistance variation depending on the environment. Therefore, it is preferable that the anodic oxide film be subjected to a sealing process in which the anodic oxide film is converted into a more stable hydrous oxide by treating the anodic oxide film with steam under pressure or boiling water (to which a metal salt of nickel or the like may be added) to seal pores by volume expansion due to microporous hydration.

The thickness of the anodic oxide film is preferably from 0.3 μm to 15 μm. When the thickness is less than 0.3 μm, barrier properties to injection may be low and the effect may be insufficient. In addition, when the thickness is greater than 15 μm, a residual potential may be increased due to repetitive use.

A surface of the electrophotographic photoreceptor 7 according to the exemplary embodiment may be subjected to a treatment using an acidic treatment solution or a boehmite treatment.

The treatment using an acidic treatment solution is performed as follows using an acidic treatment solution containing phosphoric acid, chromic acid, and hydrofluoric acid. Regarding the mixing ratio of phosphoric acid, chromic acid, and hydrofluoric acid in the acidic treatment solution, it is preferable that the content of phosphoric acid be in a range of from 10% by weight to 11% by weight; the content of chromic acid be in a range of from 3% by weight to 5% by weight; the content of hydrofluoric acid be in a range of from 0.5% by weight to 2% by weight; and the concentration of all the acids be in a range of from 13.5% by weight to 18% by weight. The treatment temperature is from 42° C. to 48° C. When the treatment temperature is maintained at a high temperature, a thick film is formed at a high speed. The thickness of a formed film is preferably from 0.3 μm to 15 μm.

The boehmite treatment is performed by dipping the conductive support 4 in pure water at a temperature of from 90° C. to 100° C. for from 5 minutes to 60 minutes; or by bringing the conductive support 4 into contact with heated steam at a temperature of from 90° C. to 120° C. for from 5 minutes to 60 minutes. The thickness of a formed film is preferably from 0.1 μm to 5 μm. The formed film may be further subjected to an anodization process using an electrolytic solution, in which a formed film has low solubility, such as adipic acid, boric acid, a borate, a phosphate, a phthalate, a maleate, a benzoate, a tartrate, or a citrate.

Undercoat Layer

The undercoat layer 1 contains an organometallic compound and a binder resin. Examples of the organometallic compound include organic zirconium compounds such as zirconium chelate compounds, zirconium alkoxide compounds, and zirconium coupling agents; organic titanium compounds such as titanium chelate compounds, titanium alkoxide compounds, and titanate coupling agents; organic aluminum compounds such as aluminum chelate compounds and aluminum coupling agents; antimony alkoxide compounds; germanium alkoxide compounds; indium alkoxide compounds; indium chelate compounds; manganese alkoxide compounds; manganese chelate compounds; tin alkoxide compounds; tin chelate compounds; aluminum silicon alkoxide compounds; aluminum titanium alkoxide compounds; and aluminum zirconium alkoxide compounds. As the organometallic compounds, organic zirconium compounds, organic titanyl compounds, or organic aluminum compounds are preferably used from the viewpoints of low residual potential and superior electrophotographic characteristics.

Examples of the binder resin included in the undercoat layer 1 include well-known binder resins such as polyvinyl alcohol, polyvinyl methyl ether, poly-N-vinylimidazole, polyethylene oxide, ethyl cellulose, methyl cellulose, ethylene-acrylic acid copolymers, polyamide, polyimide, casein, gelatin, polyethylene, polyester, phenol resins, vinyl chloride-vinyl acetate copolymers, epoxy resins, polyvinylpyrrolidone, polyvinylpyridine, polyurethane, polyglutamic acids, polyacrylic acids, and butyral resins. The mixing ratio of the organometallic compound and the binder resin is appropriately set.

In addition, the undercoat layer 1 may contain a silane coupling agent such as vinyltrichlorosilane, vinyltrimethoxysilane, vinyltriethoxysilane, vinyl tris-2-methoxyethoxysilane, vinyltriacetoxysilane, 3-glycidoxypropyltrimethoxysilane, 3-methacryloxypropyltrimethoxysilane, 3-aminopropyltriethoxysilane, 3-chloropropyltrimethoxysilane, 3-(2-aminoethylamino)propyltrimethoxysilane, 3-mercaptopropyltrimethoxysilane, 3-ureidopropyltriethoxysilane, and 2-(3,4-epoxycyclohexyl)trimethoxysilane In addition, an electron-transporting pigment may be added to or dispersed in the undercoat layer 1. Examples of the electron-transporting pigment include organic pigments such as perylene pigments, bisbenzimidazole perylene pigments, polycyclic quinone pigments, indigo pigments, and quinacridone pigments; organic pigments having an electron-attracting substituent (for example, a cyano group, a nitro group, a nitroso group, or a halogen atom) such as bisazo pigments and phthalocyanine pigments; and inorganic pigments such as zinc oxide and titanium oxide. Among these pigments, perylene pigments, bisbenzimidazole perylene pigments, polycyclic quinone pigments, zinc oxides, and titanium oxides are preferable due to their high electron mobility.

In addition, in order to control dispersibility and charge transporting properties, surfaces of pigment particles may be treated with the above-described coupling agent, binder resin or the like. An excess amount of the electron-transporting pigment reduces the strength of the undercoat layer, which may cause defects of a coating film. Therefore, the content thereof is preferably less than or equal to 95% by weight and more preferably less than or equal to 90% by weight.

The undercoat layer 1 is formed using an undercoat layer-forming coating solution containing the above-described respective constituent materials.

Examples of a method of mixing and dispersing the undercoat layer-forming coating solution include ordinary methods using a ball mill, a roll mill, a sand mill, an attritor, ultrasonic waves, or the like. Mixing and dispersing are performed in an organic solvent. Any organic solvents may be used as long as the organometallic compound and the binder resin are soluble therein; and when the electron-transporting pigment is mixed and dispersed therewith, gelation and aggregation do not occur.

Examples of the organic solvent include well-known organic solvents such as methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, chloroform, chlorobenzene, and toluene. Among these, one kind may be used alone or a mixture of two or more kinds may be used.

In addition, examples of a coating method used for providing the undercoat layer 1 include well-known methods such as a blade coating method, a wire bar coating method, a spray coating method, a dip coating method, a bead coating method, an air knife coating method, and a curtain coating method.

After coating, a coating film is usually dried to obtain the undercoat layer at a temperature at which a solvent may be evaporated to form a film. In particular, since the conductive support 4, subjected to the acidic solution treatment or the boehmite treatment, is likely to have low defect hiding power, it is preferable that the undercoat layer 1 be formed.

The thickness of the undercoat layer 1 is preferably from 0.1 μm to 30 μm and more preferably 0.2 μm to 25 μm.

Charge Generation Layer

The charge generation layer 2 contains a charge generation material or contains a charge generation material and a binder resin.

Examples of the charge generation material include well-known pigments, for example, azo pigments such as bisazo and trisazo; condensed ring aromatic pigments such as dibromoanthanthrone; organic pigments such as perylene pigments, pyrrolopyrrole pigments, and phthalocyanine pigments; and inorganic pigments such as trigonal selenium and zinc oxide. As the charge generation material, when a light source having an exposure wavelength of from 380 nm to 500 nm is used, inorganic pigments are preferable; and when a light source having an exposure wavelength of from 700 nm to 800 nm is used, metal and metal-free phthalocyanine pigments are preferable. Among these, hydroxygallium phthalocyanine; chlorogallium phthalocyanine; dichlorotin phthalocyanine; and titanyl phthalocyanine are particularly preferable.

In addition, as the charge generation material, hydroxygallium phthalocyanine having diffraction peaks at Bragg angles (2θ±0.2° with respect to CuKα characteristic X-rays of 7.5°, 9.9°, 12.5°, 16.3°, 18.6°, 25.1°, and 28.3°; titanyl phthalocyanine having a distinctive diffraction peak at a Bragg angle (2θ±0.2° of 27.2° with respect to CuKα characteristic X-rays; and chlorogallium phthalocyanine having distinctive diffraction peaks at Bragg angles (2θ±0.2° with respect to CuKα characteristic X-rays of 7.4°, 16.6°, 25.5°, and 28.3° are preferable.

The binder resin included in the charge generation layer 2 is selected from a wide range of insulating resins. In addition, the binder resin may be selected from organic photoconductive polymers such as poly-N-vinylcarbazole, polyvinyl anthracene, polyvinyl pyrene, and polysilane. Preferable examples of the binder resin include insulating resins such as polyvinyl butyral resins, polyarylate resins (for example, polycondensates of bisphenols and aromatic divalent carboxylic acids such as a polycondensate of bisphenol A and phthalic acid), polycarbonate resins, polyester resins, phenoxy resins, vinyl chloride-vinyl acetate copolymers, polyamide resins, acrylic resins, polyacrylamide resins, polyvinylpyridine resins, cellulose resins, urethane resins, epoxy resins, casein, polyvinyl alcohol resins, and polyvinylpyrrolidone resins. However, the binder resin is not limited thereto. As the binder resin, one kind may be used alone or a mixture of two or more kinds may be used.

The charge generation layer 2 is formed by vapor deposition using the above-described charge generation material or is formed using a charge generation layer-forming coating solution which contains the above-described charge generation material and the binder resin.

In the charge generation layer-forming coating solution, the mixing ratio (weight ratio) of the charge generation material and the binder resin is preferably from 10:1 to 1:10. In addition, examples of a method of dispersing the charge generation material and the binder resin include well-known methods such as a ball mill dispersing method, an attritor dispersing method, and a sand mill dispersing method. According to these dispersing methods, changes in the crystal form of the charge generation material are suppressed.

Furthermore, during dispersing, an effective particle diameter is preferably less than or equal to 0.5 μm, more preferably less than or equal to 0.3 μm, and still more preferably less than or equal to 0.15 μm.

Examples of a solvent used for dispersing include well-known organic solvents such as methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, chloroform, chlorobenzene, and toluene. Among these, one kind may be used alone or a mixture of two or more kinds may be used.

Examples of a coating method used for providing the charge generation layer 2 include well-known methods such as a blade coating method, a wire bar coating method, a spray coating method, a dip coating method, a bead coating method, an air knife coating method, and a curtain coating method.

The thickness of the charge generation layer 2 is preferably from 0.1 μm to 5 μm and more preferably from 0.2 μm to 2.0 μm.

Charge Transport Layer

The charge transport layer 3 contains a charge transport material and a binder resin or contains a charge transport polymer material.

Examples of the charge transport material include electron-transporting compounds such as quinone-based compounds (for example, p-benzoquinone, chloranil, bromanil, and anthraquinone), tetracyanoquinodimethane-based compounds, fluorenone compounds (for example, 2,4,7-trinitrofluorenone), xanthone-based compounds, benzophenone-based compounds, cyanovinyl-based compounds, ethylene-based compounds; and hole-transporting compounds such as triarylamine-based compounds, benzidine-based compounds, arylalkane-based compounds, aryl-substituted ethylene-based compounds, stilbene-based compounds, anthracene-based compounds, and hydrazone-based compounds. As the charge transport material, one kind may be used alone or a mixture of two or more kinds may be used. However, the charge transport material is not limited thereto.

In addition, it is preferable that the electron transport material be a compound represented by Formula (a-1), (a-2), or (a-3), from the viewpoint of mobility.

(a-1)

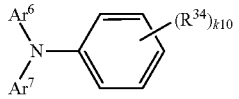

In Formula (a-1), $R^{34}$ represents a hydrogen atom or a methyl group; and k10 represents 1 or 2. In addition, $Ar^6$ and $Ar^7$ represent a substituted or unsubstituted aryl group, $—C_6H_4—C(R^{36})=C(R^{39})(R^{40})$ or $—C_6H_4—CH=CH—CH=C(Ar))_2$. Examples of a substituent include a halogen atom, an alkyl group having from 1 to 5 carbon atoms, an alkoxy group having from 1 to 5 carbon atoms, or a substituted amino group which is substituted with an alkyl group having from 1 to 3 carbon atoms. In addition, $R^{38}$, $R^{39}$, and $R^{40}$ represent a hydrogen atom, a substituted or unsubstituted alkyl group or a substituted or unsubstituted aryl group; and Ar represents a substituted or unsubstituted aryl group.

(a-2)

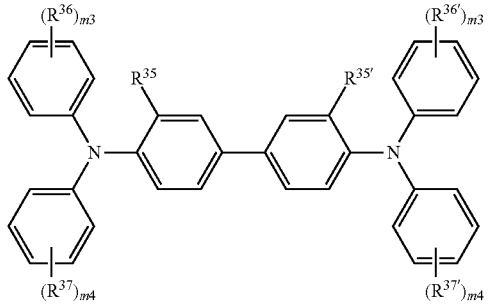

In Formula (a-2), $R^{35}$ and $R^{35'}$ each independently represent a hydrogen atom, a halogen atom, an alkyl group having from 1 to 5 carbon atoms, or an alkoxy group having from 1 to 5 carbon atoms; $R^{36}$, $R^{36'}$, $R^{37}$, and $R^{37'}$ each independently represent a halogen atom, an alkyl group having from 1 to 5 carbon atoms, an alkoxy group having from 1 to 5 carbon atoms, an amino group which is substituted with an alkyl group having 1 or 2 carbon atoms, a substituted or unsubstituted aryl group, $—C(R^{38})=C(R^{39})(R^{40})$, or $—CH=CH—CH=C(Ar)_2$; $R^{38}$, $R^{39}$, and $R^{40}$ each independently represent a hydrogen atom, a substituted or unsubstituted alkyl group, or a substituted or unsubstituted aryl group; and Ar represents a substituted or unsubstituted aryl group. m3 and m4 each independently represent an integer of from 0 to 2.

(a-3)

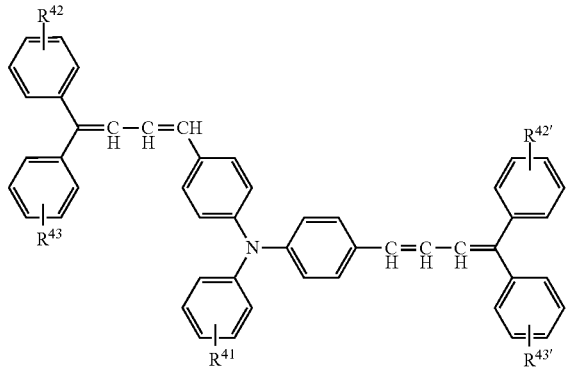

In Formula (a-3), $R^{41}$ represents a hydrogen atom, an alkyl group having from 1 to 5 carbon atoms, an alkoxy group having from 1 to 5 carbon atoms, a substituted or unsubstituted aryl group, or $—CH=CH—CH=C(Ar)_2$. Ar represents a substituted or unsubstituted aryl group. $R^{42}$, $R^{42'}$, $R^{43}$, and $R^{43'}$ each independently represent a hydrogen atom, a halogen atom, an alkyl group having from 1 to 5 carbon atoms, an alkoxy group having from 1 to 5 carbon atoms, an amino group which is substituted with an alkyl group having 1 or 2 carbon atoms, or a substituted or unsubstituted aryl group.

Examples of the binder resin included in the charge transport layer 3 include charge transport polymer materials such as polycarbonate resins, polyester resins, methacrylic resins, acrylic resins, polyvinyl chloride resins, polyvinylidene chloride resins, polystyrene resins, polyvinyl acetate resins, styrene-butadiene copolymers, vinylidene chloride-acrylonitrile copolymers, vinyl chloride-vinyl acetate copolymers, vinyl chloride-vinyl acetate-maleic anhydride copolymers, silicone resins, silicone-alkyd resins, phenol-formaldehyde resins, styrene-alkyd resins, poly-N-vinylcarbazole, polysilane, and polyester-based charge transport polymer materials. As the binder resin, one kind may be used alone or a mixture of two or more kinds may be used. The mixing ratio (weight ratio) of the charge transport material and the binder resin is preferably from 10:1 to 1:5.

In addition, the charge transport polymer material may be used alone. Examples of the charge transport polymer material include well-known charge-transporting materials such as poly-N-vinylcarbazole and polysilane. In particular, the polyester-based charge transport polymer materials are particularly preferable from the viewpoint of high charge transporting properties. The charge transport polymer material may be used alone as a charge transport layer or may be mixed with the binder resin to form a film.

The charge transport layer 3 is formed using a charge transport layer-forming coating solution which contains the above-described constituent materials. Examples of a solvent used for the charge transport layer-forming coating solution include well-known organic solvents, for example, aromatic hydrocarbons such as benzene, toluene, xylene, and chlorobenzene; ketones such as acetone and 2-butanone; halogenated aliphatic hydrocarbons such as methylene chloride, chloroform, and ethylene chloride; and cyclic or linear ethers such as tetrahydrofuran and ethyl ether. As the solvent, one kind may be used alone, or a mixture of two or more kinds may be used. In addition, examples of a method of dispersing the above-described respective constituent materials include well-known methods.

Examples of a method of coating the charge transport layer-forming coating solution on the charge generation layer 2 include well-known methods such as a blade coating method, a wire bar coating method, a spray coating method, a dip coating method, a bead coating method, an air knife coating method, and a curtain coating method.

The thickness of the charge transport layer 3 is preferably from 5 μm to 50 μm and more preferably from 10 μm to 30 μm.

Protective Layer

The protective layer 6 is the outermost layer in the electrophotographic photoreceptor 7B, and is optionally provided in order to impart resistance to wear, scratches, and the like to the outermost surface and to increase toner transfer efficiency.

When the protective layer 6 is provided as the outermost layer, the protective layer 6 is formed by, in addition to fluorine-based particles, the charge transport material and the binder resin being contained as in the case of the charge transport layer 3; or is formed by crosslinking a crosslinkable charge transport material.

Preferable examples of the crosslinkable charge transport material used for the protective layer 6 include charge transport materials having at least one substituent selected from —OH, —$OCH_3$, —SH, and —COOH. In this case, it is preferable that at least two (more preferably, three) substituents be included from the viewpoint of improving crosslinking density.

It is preferable that the charge transport material used for the protective layer 6 be a compound represented by Formula (I).

$$F_0—((—R_1—X)_{n1}R_2—Y)_{n2} \quad (I)$$

In Formula (I), $F_0$ represents an organic group derived from a compound having a hole-transporting capability; $R_1$ and $R_2$ each independently represent a linear or branched alkylene group having from 1 to 5 carbon atoms; n1 represents 0 or 1; and n2 represents an integer of from 1 to 4. X represents an oxygen atom, NH or a sulfur atom; and Y represents —OH, —$OCH_3$, —$NH_2$, —SH, or —COOH.

Regarding the organic group derived from a compound having a hole-transporting capability represented by F in Formula (I), preferable examples of the compound having a hole-transporting capability include arylamine derivatives. Preferable examples of the arylamine derivatives include triphenylamine derivatives and tetraphenylbenzidine derivatives.

It is preferable that the compound represented by Formula (I) be a compound represented by Formula (II). The compound represented by Formula (II) has, in particular, superior charge mobility and stability to oxidation and the like.

(II)

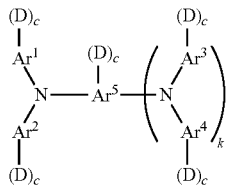

In Formula (II), $Ar^1$ to $Ar^4$ may be the same as or different from each other and each independently represent a substituted or unsubstituted aryl group; $Ar^5$ represents a substituted or unsubstituted aryl group or a substituted or unsubstituted arylene group; D represents —(—$R_1$—X)$_{n1}$$R_2$—Y; c's each independently represent 0 or 1; k represents 0 or 1; and the total number of D's is from 1 to 4. In addition, $R_1$ and $R_2$ each independently represent a linear or branched alkylene group having from 1 to 5 carbon atoms; n1 represents 0 or 1; X represents an oxygen atom, NH, or a sulfur atom; and Y represents —OH, —$OCH_3$, —$NH_2$, —SH, or —COOH.

"—(—$R_1$—X)$_{n1}$$R_2$—Y" represented by D in Formula (II) is the same as in the Formula (I), and $R_1$ and $R_2$ each independently represent a linear or branched alkylene group having from 1 to 5 carbon atoms. In addition, it is preferable that n1 represent 1. In addition, it is preferable that X represent an oxygen atom. In addition, it is preferable that Y represent a hydroxyl group.

Specific examples of the compound represented by Formula (I) include the following compounds (I)-1 to (I)-5. However, the compound represented by Formula (I) is not limited to these examples.

(I)-1

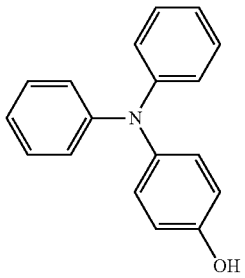

(I)-2

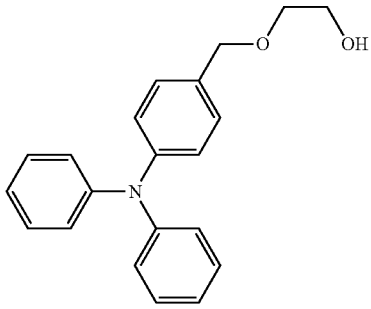

(I)-3

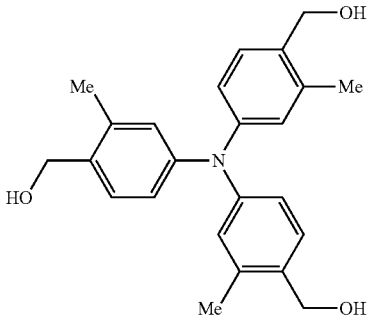

(I)-4

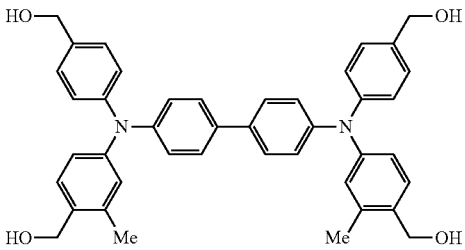

-continued (I)-5

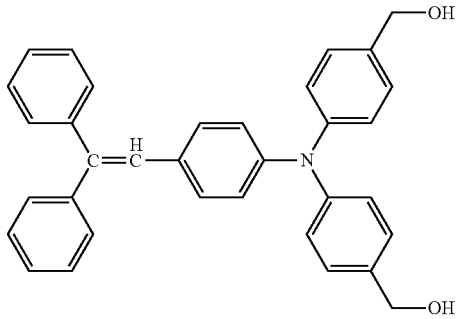

In addition, when the crosslinkable charge transport material is used for the protective layer 6, a compound (guanamine compound) having a guanamine skeleton (structure) and a compound (melamine compound) having a melamine skeleton (structure) may be used.

Examples of the guanamine compound include acetoguanamine, benzoguanamine, formoguanamine, steroguanamine, spiroguanamine, and cyclohexylguanamine which are compounds having a guanamine skeleton (structure).

It is particularly preferable that the guanamine compound be at least one kind of a compound represented by Formula (A) and a polymer thereof. The polymer described herein represents an oligomer which is polymerized using a compound represented by Formula (A) as a structural unit. The polymerization degree thereof is, for example, from 2 to 200 (preferably, from 2 to 100). As the compound represented by Formula (A), one kind may be used alone or two or more kinds may be used in combination. In particular, as the compound represented by Formula (A), when a mixture of two or more kinds is used or a polymer (oligomer) having the mixture as a structural unit is used, the solubility in a solvent is improved.

(A)

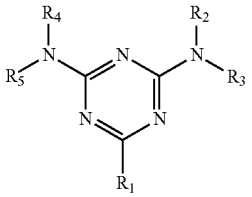

In Formula (A), $R_1$ represents a linear or branched alkyl group having from 1 to 10 carbon atoms, a substituted or unsubstituted phenyl group having from 6 to 10 carbon atoms, and a substituted or unsubstituted alicyclic hydrocarbon group having from 4 to 10 carbon atoms. $R_2$ to $R_5$ each independently represent a hydrogen atom, —$CH_2$—OH, or —$CH_2$—O—$R_6$. $R_6$ represents a hydrogen atom or a linear or branched alkyl group having from 1 to 10 carbon atoms.

Examples of commercially available products of the compound represented by Formula (A) include SUPER BECKAMINE (R) L-148-55, SUPER BECKAMINE (R) 13-535, SUPER BECKAMINE (R) L-145-60 and SUPER BECKAMINE (R) TD-126 (all of which are manufactured by DIC Corporation); and NIKALAC BL-60 and NIKALAC BX-4000 (both of which are manufactured by Nippon Carbide Industries Co., Inc.).

Next, the melamine compound will be described.

It is particularly preferable that the melamine compound be at least one kind of a compound represented by Formula (B) and a polymer thereof which is a compound having a melamine skeleton (structure). Similarly to the case of Formula (A), the polymer described herein represents an oligomer which is polymerized using a compound represented by Formula (B) as a structural unit. The polymerization degree thereof is, for example, from 2 to 200 (preferably, from 2 to 100). As the compound represented by Formula (B) or the polymer thereof, one kind may be used alone or two or more kinds may be used in combination. The compound represented by Formula (B) may be used in combination with the compound represented by Formula (A) or polymers thereof. In particular, as the compound represented by Formula (B), when a mixture of two or more kinds is used or a polymer (oligomer) having the mixture as a structural unit is used, the solubility in a solvent is improved.

(B)

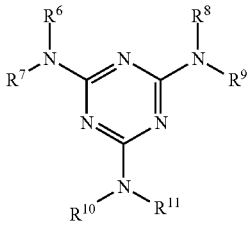

In Formula (B), $R^6$ to $R^{11}$ each independently represent a hydrogen atom, —$CH_2$—OH, or —$CH_2$—O—$R^{12}$; and $R^{12}$ represents an alkyl group having from 1 to 5 carbon atoms which may be branched. Examples of $R^{12}$ include a methyl group, an ethyl group, and a butyl group.

The compound represented by Formula (B) is synthesized using, for example, melamine and formaldehyde according to a well-known method (for example, the same synthesis method as that of a melamine resin described in Jikken Kagaku Koza 4th edition, vol. 28, p. 430).

Examples of commercially available products of the compound represented by Formula (B) include SUPER MELAMI No. 90 (manufactured by NOF Corporation), SUPER BECKAMINE (R) TD-139-60 (manufactured by DIC Corporation), UBAN 2020 (manufactured by Mitsui Chemicals Inc.), SUMITEX RESIN M-3 (manufactured by Sumitomo Chemical Co., Ltd.), and NIKALAC MW-30 (manufactured by Nippon Carbide Industries Co., Inc.).

It is preferable that an antioxidant be added to the protective layer 6 in order to prevent deterioration due to oxidizing gas such as ozone which is generated in a charging device. When the mechanical strength of a surface of a photoreceptor is improved and the lifetime of the photoreceptor is increased, the photoreceptor is in contact with oxidizing gas for a long time. Therefore, higher oxidation resistance than that of the related art is required. As the antioxidant, hindered phenol-based or hindered amine-based antioxidants are preferable, and well-known antioxidants such as organic sulfur-based antioxidants, phosphite-based antioxidants, dithiocarbamate-based antioxidants, thiourea-based antioxidants, and benzimidazole-based antioxidants may be used. The amount of the antioxidant added is preferably less than or equal to 20% by weight and more preferably less than or equal to 10% by weight.

Furthermore, in order to reduce residual potential or to improve strength, various kinds of particles may be added to the protective layer 6. Examples of the particles include silicon-containing particles. The silicon-containing particles contain silicon as a constituent element, and specific examples thereof include colloidal silica or silicone particles. The colloidal silica used as the silicon-containing particles is selected from materials obtained by dispersing silica having an average particle diameter of from 1 nm to 100 nm and preferably from 10 nm to 30 nm in an acidic or alkaline aqueous dispersion or in an organic solvent such as an alcohol, a ketone, or an ester, and a commercially available product may be used. The solid content of the colloidal silica in the protective layer 6 is not particularly limited. From the viewpoints of film-forming properties, electrical characteristics, and strength, the solid content is from 0.1% by weight to 50% by weight and preferably from 0.1% by weight to 30% by weight with respect to the total solid content of the protective layer 6.

The silicone particles used as the silicon-containing particles are selected from silicone resin particles, silicone rubber particles, and silicone surface-treated silica particles, and a commercially available product may be used. These silicone particles have a circular shape and an average particle diameter of preferably from 1 nm to 500 nm and more preferably from 10 nm to 100 nm. The silicone particles are chemically inert, have superior dispersibility in a resin and a small particle diameter, and a small amount thereof is required for obtaining sufficient characteristics. Therefore, surface properties of the electrophotographic photoreceptor are improved without interfering with a crosslinking reaction. That is, in a state of being incorporated into a strong crosslinking structure without variation, the silicone particles improve the lubricity and water repellency of a surface of the electrophotographic photoreceptor and maintain satisfactory wear resistance and resistance to contaminant adhesion over a long period of time. The content of the silicone particles in the protective layer 6 is preferably from 0.1% by weight to 30% by weight and more preferably from 0.5% by weight to 10% by weight with respect to the total solid content of the protective layer 6.

In addition, fluorine-containing resin particles may be used as other particles.

The fluorine-containing resin particles are formed from one kind or two or more kinds selected from a group consisting of polytetrafluoroethylene, perfluoroalkoxy fluororesins, polychlorotrifluoroethylene, polyvinylidene fluoride, polydichlorodifluoroethylene, tetrafluoroethylene-perfluoroalkylvinylether copolymers, tetrafluoroethylene-hexafluoropropylene copolymers, tetrafluoroethylene-ethylene copolymers, and tetrafluoroethylene-hexafluoropropylene-perfluoroalkylvinylether copolymers.

Commercially available fluorine-containing resin particles may be used without any change. In the fluorine-containing resin particles, those having the molecular weight of from 3,000 to 5,000,000 and the particle diameter of from 0.01 μm to 10 μm and preferably from 0.05 μm to 2.0 μm may be used.

Examples of commercially available products thereof include LUBRON series (manufactured by Daikin Industries Ltd.), TEFLON (trade name) series (manufactured by du Pont de Nemours and Company), and DYNEON series (manufactured by Sumitomo 3M Ltd.).

Examples of oligomers containing fluorine atoms include oligomers containing perfluoroalkyl, and preferable examples thereof include perfluoroalkyl sulfonic acids (for example, perfluorobutane sulfonic acid and perfluorooctane sulfonic acid), perfluoroalkyl carboxylic acids (for example, perfluorobutane carboxylic acid and perfluorooctane carboxylic acid), and perfluoroalkyl group-containing phosphoric acid esters.

Perfluoroalkyl sulfonic acids and perfluoroalkyl carboxylic acids may include salts thereof or amide-modified products thereof. Specific examples thereof include GF300 (manufactured by Toagosei Co., Ltd.), SURFLON series (manufactured by ACC Seimi Chemical Co., Ltd.), FTERGENT series (manufactured by Neos company Ltd.), PF series (manufactured by Kitamura Chemicals Co., Ltd.), MEGAFAC series (manufactured by DIG Corporation), FC series (manufactured by 3M Company), POLYFLOW KL600 (manufactured by Kyoeisha Chemical Co., Ltd.), and FTOP series (manufactured by Japan Electronic Monetary Claim Organization). Commercially available fluorine-containing resin particles may be used without any change, and a mixture of plural kinds may be used.

The protective layer 6 is formed by coating a coating solution which contains the components. The protective layer-forming coating solution may be prepared without using a solvent or, optionally, may be prepared using a solvent, for example, alcohols such as methanol, ethanol, propanol, and butanol; ketones such as acetone and methyl ethyl ketone; or ethers such as tetrahydrofuran, diethyl ether, and dioxane. As the solvent, one kind may be used alone or a mixture of two or more kinds may be used, in which the boiling point is preferably lower than or equal to 100° C. As the solvent, a solvent (for example, alcohols) having at least one kind of hydroxyl group is preferably used.

The protective layer-forming coating solution may be coated on the charge transport layer 3 using a well-known method such as a blade coating method, a wire bar coating method, a spray coating method, a dip coating method, a bead coating method, an air knife coating method, or a curtain coating method. In this case, it is preferable that a coating region for the undercoat layer 1, the charge generation layer 2, and the charge transport layer 3 below the protective layer 6 be wide; and that the protective layer-forming coating solution be directly coated on the conductive support 4. The width of the conductive support 4 which is directly coated with the protective layer-forming coating solution is preferably greater than or equal to 0.5 mm. When the width is less than 0.5 mm, partial peeling may occur due to a reduction in adhesion area. Optionally, such a coating film may be heated at a temperature of, for example, from 100° C. to 170° C. to be cured. As a result, the protective layer 6 is obtained.

In the above-described exemplary embodiment, the examples of the function separation type electrophotographic photoreceptor 7B have been described. On the other hand, in the single-layer type photosensitive layer 10 (charge generation and charge transport layer) illustrated in FIGS. 4 and 5, the content of the charge generation material is approximately from 10% by weight to 85% by weight and preferably from 20% by weight to 50% by weight. In addition, the content of the charge transport material is preferably from 5% by weight to 50% by weight.

A method of forming the single-layer type photosensitive layer 10 is the same as the method of forming the charge generation layer 2 or the charge transport layer 3.

The thickness of the single-layer type photosensitive layer 10 is preferably from 5 μm to 50 μm and more preferably from 10 μm to 40 μm.

In addition, in the above-described exemplary embodiment, a crosslinking material of at least one kind selected from the guanamine compound (compound represented by Formula (A)) and the melamine compound (compound represented by Formula (B)); and a specific charge transport material (compound represented by Formula (I)) is used for the protective layer 6. However, in a layer configuration not having the protective layer 6, the above-described crosslinking material may be used for, for example, a charge transport layer which is the outermost layer.

Process Cartridge and Image Forming Apparatus

Next, a process cartridge and an image forming apparatus using the electrophotographic photoreceptor according to the exemplary embodiment will be described.

A process cartridge according to an exemplary embodiment of the invention includes the electrophotographic photoreceptor according to the exemplary embodiment and is detachable from an image forming apparatus.

In addition, an image forming apparatus according to an exemplary embodiment of the invention includes the electrophotographic photoreceptor according to the exemplary embodiment; a charging unit that charges a surface of the electrophotographic photoreceptor; an electrostatic latent image forming unit that forms an electrostatic latent image on a charged surface of the electrophotographic photoreceptor; a developing unit that develops the electrostatic latent image, formed on the surface of the electrophotographic photoreceptor, using a developer containing toner to form a toner image; and a transfer unit that transfers the toner image, formed on the surface of the electrophotographic photoreceptor, onto a recording medium.

The image forming apparatus according to the exemplary embodiment may be a so-called tandem machine which includes plural photoreceptors corresponding to the respective color toners. In this case, it is preferable that all the photoreceptors be the electrophotographic photoreceptor according to the exemplary embodiment. In addition, a toner image may be transferred with an intermediate transfer method using an intermediate transfer medium.

Figure 8:
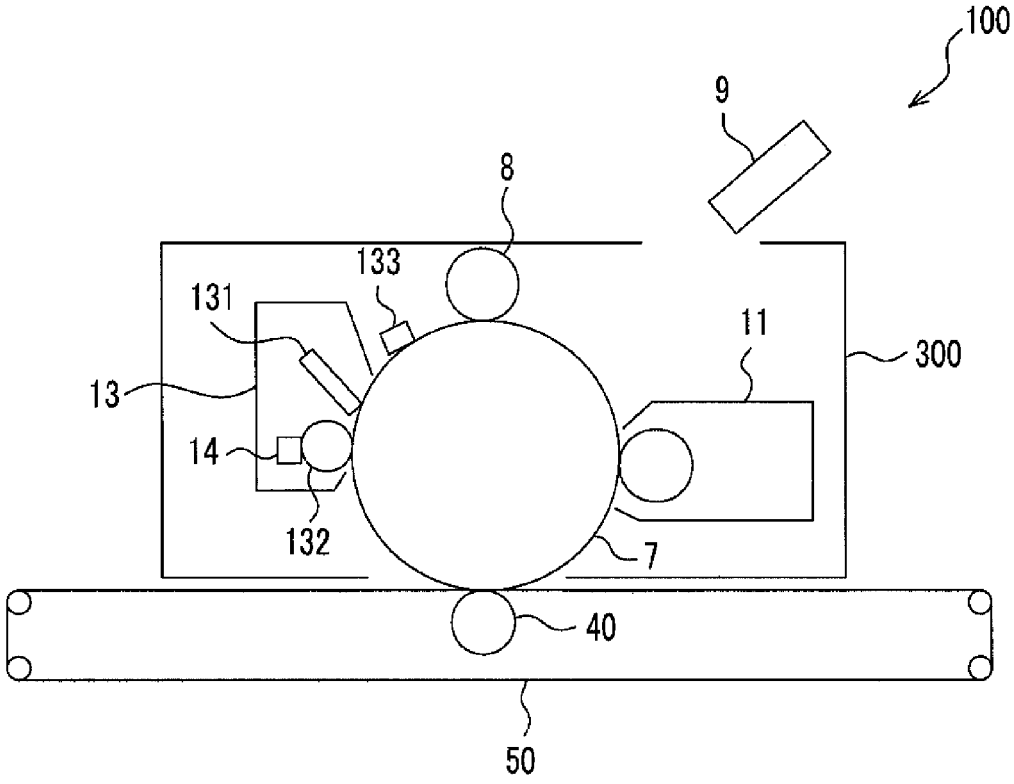
FIG. 8 is a diagram schematically illustrating a configuration example of an image forming apparatus according to an exemplary embodiment of the invention.

FIG. 8 is a diagram schematically illustrating a configuration example of the image forming apparatus according to the exemplary embodiment. As illustrated in FIG. 8, an image forming apparatus 100 includes a process cartridge 300 having an electrophotographic photoreceptor 7, an exposure device 9, a transfer device 40, and an intermediate transfer medium 50. In the image forming apparatus 100, the exposure device 9 is arranged at a position at which the electrophotographic photoreceptor 7 is exposed to light through an opening of the process cartridge 300; the transfer device 40 is arranged at a position which faces the electrophotographic photoreceptor 7 with the intermediate transfer medium 50 interposed therebetween; and the intermediate transfer medium 50 is arranged such that a part thereof is in contact with the electrophotographic photoreceptor 7.

In the process cartridge 300 which constitutes a part of the image forming apparatus 100 illustrated in FIG. 8, the electrophotographic photoreceptor 7, the charging device 8 (an example of the charging unit), the developing device 11 (an example of the developing unit), and a cleaning device 13 (an example of a toner removal unit) are integrally supported in a housing. The cleaning device 13 includes a cleaning blade 131 (cleaning member). The cleaning blade 131 is arranged in contact with a surface of the electrophotographic photoreceptor 7 so as to remove toner remaining on the surface of the electrophotographic photoreceptor 7.

In an example illustrated in the drawing, the cleaning device 13 includes, in addition to the cleaning blade 131, a fibrous member 132 (roll shape) that supplies a lubricant 14 to the surface of the electrophotographic photoreceptor 7 and a fibrous member 133 (flat brush shape) that assists cleaning. However, these members are not necessarily used.

Examples of the charging device 8 include contact charging devices using a charging roller, a charging brush, a charging film, a charging rubber blade, a charging tube, and the like which are conductive or semi-conductive. In addition, non-contact roller charging devices and well-known charging devices such as a scorotron charger or corotron charger using corona discharge may also be used.

Although not illustrated in the drawing, a photoreceptor heating member that increases the temperature of the electrophotographic photoreceptor 7 to reduce the relative temperature may be provided in the vicinity of the electrophotographic photoreceptor 7.

Examples of the exposure device 9 (an example of the electrostatic latent image forming unit) include optical devices with which the surface of the electrophotographic photoreceptor 7 is exposed to light such as semiconductor laser light, LED light, and liquid crystal shutter light according to a predetermined image form. The wavelength of a light source used falls within the spectral sensitivity range of the electrophotographic photoreceptor. Generally, the wavelength of a semiconductor laser light is in the near-infrared range having an oscillation wavelength of about 780 nm. However, the wavelength is not limited thereto. Laser light having an oscillation wavelength of about 600 nm or laser light having an oscillation wavelength of from 400 nm to 450 nm as blue laser light may be used. In addition, in order to form a color image, for example, a surface-emitting laser light source capable of emitting multiple beams is also effective.

As the developing device 11, a general developing device that performs development with or without contact with a magnetic or non-magnetic single-component developer, two-component developer, or the like may be used. The developing device is not particularly limited as long as it has the above-described function and is selected according to the purpose. Examples thereof include well-known developing units which have a function of attaching the above-described single-component developer or two-component developer to the electrophotographic photoreceptor 7 using a brush, a roller, or the like. Among these, a developing unit using a developing roller which holds the developer on a surface thereof is preferable.

Hereinafter, a toner used for the developing device 11 will be described.

In the toner used for the image forming apparatus according to the exemplary embodiment, the average shape factor $((ML^2/A)\times(\pi/4)\times100$; wherein ML represents a maximum length of particles and A represents a projected area of particles) is preferably from 100 to 150, more preferably from 105 to 145, and still more preferably from 110 to 140. Furthermore, in the toner, the volume average particle diameter is preferably from 3 μm to 12 μm and more preferably from 3.5 μm to 9 μm.

A method of preparing the toner is not particularly limited, and examples thereof include a kneading pulverization method in which a binder resin, a colorant, and a release agent (optionally, a charge-controlling agent) are added, followed by kneading, pulverization, and classification; a method in which shapes of particles obtained in the kneading and pulverization method are modified by mechanical impact or thermal energy; an emulsion polymerization aggregation method in which a dispersion, formed by emulsion-polymerizing polymerizable monomers of a binder resin, and a dispersion of a colorant and a release agent (optionally a charge-controlling agent) are mixed, followed by aggregation and thermal coalescence to obtain toner particles; a suspension polymerization method in which polymerizable monomers for obtaining a binder resin and a solution of a colorant and a release agent (optionally a charge-controlling agent) are suspended in an aqueous solvent for polymerization; and a dissolution suspension method in which a binder resin and a solution of a colorant and a release agent (optionally, a charge-controlling agent) are suspended in an aqueous medium for granulation.

In addition, a well-known method such as a preparation method in which toner particles obtained in the above-described method are used as a core; and aggregated particles are attached and thermally coalesced to have a core-shell structure, is used. As the method of preparing the toner, the suspension polymerization method, the emulsion polymerization aggregation method, and the dissolution suspension method which use an aqueous medium for the preparation are preferable and the emulsion polymerization aggregation method is particularly preferable, from the viewpoints of controlling the shape and the particle diameter distribution.

It is preferable that toner particles contain a binder resin, a colorant, and a release agent. The toner particles may further contain silica or a charge-controlling agent.

Examples of the binder resin used for the toner particles include homopolymers and copolymers of styrenes (for example, styrene and chlorostyrene), monoolefines (for example, ethylene, propylene, butylene, and isoprene), vinyl esters (for example, vinyl acetate, vinyl propionate, vinyl benzoate, and vinyl butyrate), α-methylene aliphatic monocarboxylic acid esters (for example, methyl acrylate, ethyl acrylate, butyl acrylate, dodecyl acrylate, octyl acrylate, phenyl acrylate, methyl methacrylate, ethyl methacrylate, butyl methacrylate, and dodecyl methacrylate), vinyl ethers (for example, vinyl methyl ether, vinyl ethyl ether, and vinyl butyl ether), and vinyl ketones (for example, vinyl methyl ketone, vinyl hexyl ketone, and vinyl isopropenyl ketone); and polyester resins obtained by copolymerization of dicarboxylic acids and dials.

Particularly, typical examples of the binder resin include polystyrene, styrene-alkyl acrylate copolymers, styrene-alkyl methacrylate copolymers, styrene-acrylonitrile copolymers, styrene-butadiene copolymers, styrene-maleic anhydride copolymers, polyethylene, polypropylene, and polyester resins. Furthermore, other examples thereof include polyurethane, epoxy resins, silicone resins, polyimide, modified rosins, and paraffin waxes.

In addition, typical examples of the colorant include magnetic powder such as magnetite or ferrite, carbon black, aniline blue, calco oil blue, chromium yellow, ultramarine blue, Dupont oil red, quinoline yellow, methylene blue chloride, phthalocyanine blue, malachite green oxalate, lamp black, rose bengal, C.I. pigment red 48:1, C.I. pigment red 122, C.I. pigment red 57:1, C.I. pigment yellow 97, C.I. pigment yellow 17, C.I. pigment blue 15:1, and C.I. pigment blue 15:3.

Typical examples of the release agent include low-molecular-weight polyethylene, low-molecular-weight polypropylene, Fischer-Tropsch wax, montan wax, carnauba wax, rice wax, and candelilla wax.

As the charge-controlling agent, well-known materials are used, and examples thereof include azo-based metal complex compounds, metal complex compounds of salicylic acid, and resin-type charge-controlling agents containing a polar group. When the toner is prepared with a wet method, it is preferable that a material that is difficult to dissolve in water be used. In addition, the toner may be a magnetic toner which contains a magnetic material or a non-magnetic toner which does not contain a magnetic material.

A toner used for the developing device 11 is obtained by mixing the above-described toner particles with the above-described external additives using, for example, a Henschel mixer or a V-blender. In addition, when the toner particles are prepared in a wet method, external addition may also be performed in a wet method.

Lubricating particles may be added to the toner used for the developing device 11. Examples of the lubricating particles include solid lubricants such as graphite, molybdenum disulfide, talc, fatty acids, and fatty acid metal salts; low-molecular-weight polyolefins such as polypropylene, polyethylene, and polybutene; silicones having a softening point when heated; aliphatic amides such as oleic amide, erucic amide, ricinoleic amide, and stearic amide; plant waxes such as carnauba wax, rice wax, candelilla wax, Japan wax, and jojoba oil; animal waxes such as beeswax; mineral or petroleum waxes such as montan wax, ozocerite, ceresin, paraffin wax, microcrystalline wax, and Fischer-Tropsch wax; and modified products thereof. Among these, one kind may be used alone or a mixture of two or more kinds may be used.

The average particle diameter is preferably from 0.1 to 10 μm, and the lubricating particles having the above-described chemical structure may be pulverized to make the particle diameters uniform.

The amount of the lubricating particles added to the toner is preferably from 0.05% by weight to 2.0% by weight and more preferably from 0.1% by weight to 1.5% by weight.

Inorganic particles, organic particles, composite particles in which inorganic particles are attached to organic particles, or the like may be added to the toner used for the developing device 11.

Preferable examples of the inorganic particles include various inorganic oxides, nitrides and borides such as silica, alumina, titania, zirconia, barium titanate, aluminum titanate, strontium titanate, magnesium titanate, zinc oxide, chromium oxide, cerium oxide, antimony oxide, tungsten oxide, tin oxide, tellurium oxide, manganese oxide, boron oxide, silicon carbide, boron carbide, titanium carbide, silicon nitride, titanium nitride, and boron nitride.

In addition, the above-described inorganic particles may be treated with a titanium coupling agent such as tetrabutyl titanate, tetraoctyl titanate, isopropyltriisostearoyl titanate, isopropyltridecylbenzenesulfonyl titanate, or bis(dioctylpyrophosphate)oxyacetate titanate; or a silane coupling agent such as 3-(2-aminoethyl)aminopropyltrimethoxysilane, 3-(2-aminoethyl)aminopropylmethyldimethoxysilane, 3-methacryloxypropyltrimethoxysilane, a hydrochloride of N-2-(N-vinylbenzylaminoethyl)-3-aminopropyltrimethoxysilane, hexamethyldisilazane, methyltrimethoxysilane, butyltrimethoxysilane, isobutyltrimethoxysilane, hexyltrimethoxysilane, octyltrimethoxysilane, decyltrimethoxysilane, dodecyltrimethoxysilane, phenyltrimethoxysilane, o-methylphenyltrimethoxysilane, or p-methylphenyltrimethoxysilane. In addition, it is preferable that the inorganic particles be hydrophobized using a silicone oil, or a higher aliphatic acid metal salt such as aluminum stearate, zinc stearate or calcium stearate.

Examples of the organic particles include styrene resin particles, styrene acrylic resin particles, polyester resin particles, and urethane resin particles.

The number average particle diameter thereof is preferably from 5 nm to 1,000 nm, more preferably from 5 nm to 800 nm, and still more preferably 5 nm to 700 nm.

It is preferable that the total amount of the above-described particles and the lubricating particles added be greater than or equal to 0.6% by weight.

As other inorganic oxide particles added to the toner, it is preferable that small-diameter inorganic oxide particles having a primary particle diameter of 40 nm or less be added and then inorganic oxide particles having a larger diameter than that of the small-diameter inorganic oxide be added. As these inorganic oxide particles, well-known materials may be used. However, it is preferable that silica and titanium oxide be used in combination.

The surfaces of the small-diameter inorganic particles may be treated. Furthermore, it is preferable that a carbonate such as calcium carbonate or magnesium carbonate, or an inorganic mineral such as hydrotalcite be added thereto.

An electrophotographic color toner is mixed with a carrier to be used. Examples of the carrier include iron powder, glass beads, ferrite powder, nickel powder, and a product obtained by coating a surface of the above examples with a resin. In addition, the mixing ratio of the toner and the carrier is appropriately set.

Examples of the transfer device 40 (an example of the transfer unit) include contact transfer charging devices using a belt, a roller, a film, a rubber blade, and the like; and well-known transfer charging devices such as a scorotron transfer charger or a corotron transfer charger using corona discharge.

Examples of the intermediate transfer medium 50 include belt-shaped members (intermediate transfer belts) which are formed of semi-conductive polyimide, polyamideimide, polycarbonate, polyarylate, polyester, or rubber. In addition, the intermediate transfer medium 50 may have a drum shape as well as a belt shape.

In addition to the above-described respective devices, the image forming apparatus 100 may further include, for example, an optical erasing device that optically erases electric charge on the electrophotographic photoreceptor 7.

In the image forming apparatus 100 illustrated in FIG. 8, the surface of the electrophotographic photoreceptor 7 is charged by the charging device 8, an electrostatic latent image is formed by the exposure device 9, and the electrostatic latent image on the surface of the electrophotographic photoreceptor 7 is developed as a toner image using the toner in the developing device 11. The toner image on the electrophotographic photoreceptor 7 is transferred onto the intermediate transfer medium 50, is transferred onto a surface of a recording medium (not illustrated), and is fixed thereon by a fixing device (not illustrated).

In a monochrome image forming apparatus, a recording medium is transported to a position at which the transfer device 40 and the electrophotographic photoreceptor 7 face each other by using a recording medium transfer belt, a recording medium transport roller, or the like instead of the intermediate transfer medium 50, and then the toner image is transferred onto the recording medium and fixed thereon.

Figure 9:
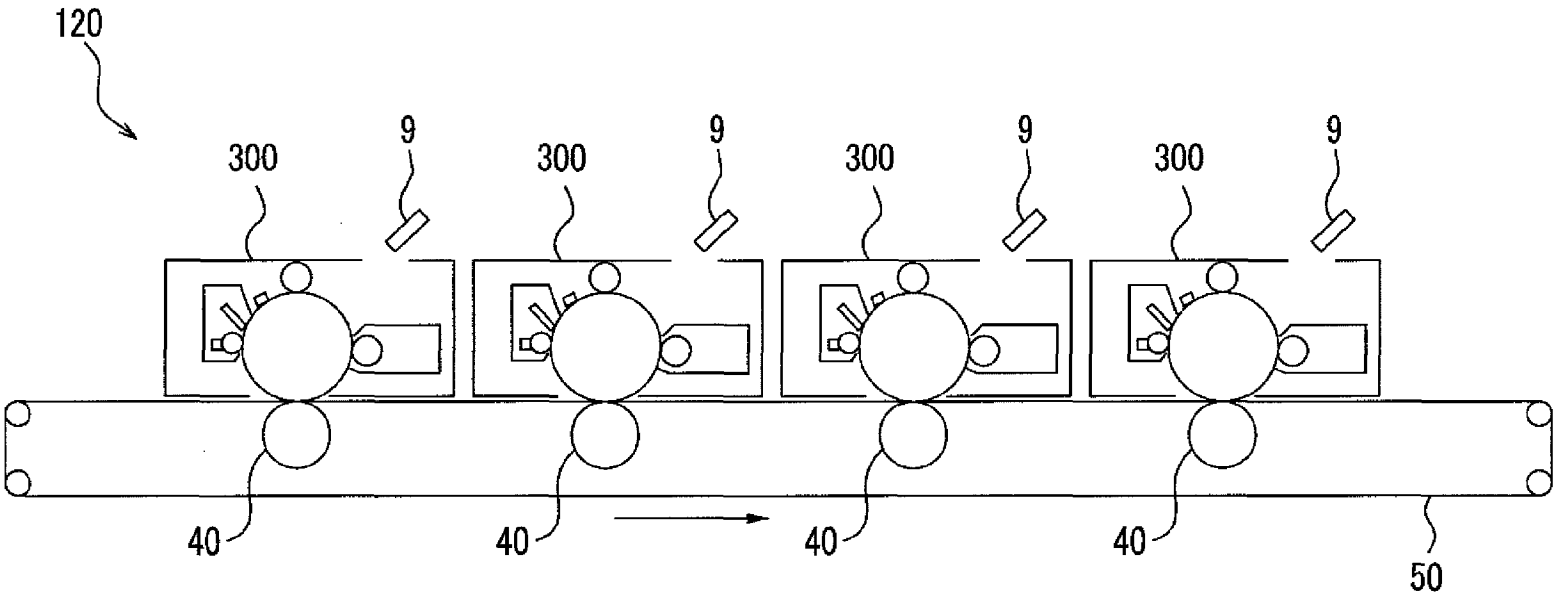
FIG. 9 is a diagram schematically illustrating another configuration example of the image forming apparatus according to the exemplary embodiment.

FIG. 9 is a diagram schematically illustrating a configuration example of the image forming apparatus according to another exemplary embodiment. As illustrated in FIG. 9, an image forming apparatus 120 is a tandem-type multi-color image forming apparatus to which four process cartridges 300 are mounted. In the image forming apparatus 120, the four process cartridges 300 are arranged in parallel on the intermediate transfer medium 50 such that one electrophotographic photoreceptor for one color is used. The image forming apparatus 120 has the same configuration as that of the image forming apparatus 100 except that it is the tandem-type.

EXAMPLES

Hereinafter, Examples of the present invention will be described, but the present invention is not limited to the following Examples.

Example 1

Preparation of Electrophotographic Photoreceptor

Preparation of Conductive Support

A conductive support is prepared with the following method. A slag, which is formed of JIS A1050-type alloy having an aluminum purity of 99.5% or higher and to which a lubricant is applied, is prepared. The slag is molded into a bottomed cylindrical pipe by impact pressing using a die (female) and a punch (male), followed by ironing. As a result, a cylindrical aluminum substrate having a diameter of 24 mm, a length of 251 mm, and a thickness of 0.5 mm is prepared.

In addition, a substrate prepared in the same manner as above is cut for a tension test using a tensile tester (manufactured by Shimadzu Corporation; AUTOGRAPH) to measure a Young's modulus of the substrate.

Undercoat Layer 100 parts by weight of zinc oxide particles (average particle diameter: 70 nm, manufactured by Tayca Corporation, specific surface area: 15 $m^2/g$) is stirred and mixed with 500 parts by weight of toluene. 1.3 parts by weight of silane coupling agent (KBM 503, manufactured by Shin-Etsu Chemical Co., Ltd.) is added thereto, followed by stirring for 2 hours. Then, toluene is removed by distillation under reduced pressure, followed by baking at 120° C. for 3 hours. As a result, zinc oxide particles with the surfaces treated with the silane coupling agent are obtained.

110 parts by weight of the surface-treated zinc oxide particles is stirred and mixed with 500 parts by weight of tetrahydrofuran. A solution, obtained by dissolving 0.6 part by weight of alizarin in 50 parts by weight of tetrahydrofuran, is added thereto, followed by stirring at 50° C. for 5 hours. Then, zinc oxide particles to which alizarin is added are separated by filtration under reduced pressure, followed by drying under reduced pressure at 60° C. As a result, alizarin-added zinc oxide particles are obtained.

60 parts by weight of the alizarin-added zinc oxide particles, 13.5 parts by weight of curing agent (blocked isocyanate SUMIDUR 3175, manufactured by Sumitomo-Bayer Urethane Co., Ltd.), and 15 parts by weight of butyral resin (S-LEC BM-1, manufactured by Sekisui Chemical Co., Ltd.) are dissolved in 85 parts by weight of methyl ethyl ketone to obtain a solution. 38 parts by weight of the solution is mixed with parts by weight of methyl ethyl ketone, followed by dispersion for 2 hours using a sand mill with 1 mmϕ glass beads. As a result, a dispersion is obtained.

0.005 part by weight of dioctyl tin dilaurate as a catalyst and 45 parts by weight of silicone resin particles (TOSPEARL 145, manufactured by GE Toshiba Silicones Co., Ltd.) are added to this dispersion. As a result, an undercoat layer-forming coating solution is obtained. This coating solution is dip-coated on the aluminum substrate which is the conductive support, followed by drying and curing at 180° C. for 30 minutes. As a result, an undercoat layer having a thickness of 23 μm is formed.

Charge Generation Layer

Next, 1 part by weight of hydroxygallium phthalocyanine having distinctive diffraction peaks at Bragg angles (2θ±0.2°) of 7.5°, 9.9°, 12.5°, 16.3°, 18.6°, 25.1°, and 28.3° in an X-ray diffraction spectrum; 1 part by weight of polyvinyl butyral (S-LEC BM-S, manufactured by Sekisui Chemical Co., Ltd.), and 80 parts by weight of n-butyl acetate are mixed to obtain a mixture. The mixture is dispersed using glass beads and a paint shaker for 1 hour to prepare a charge generation layer-forming coating solution. The obtained coating solution is dip-coated on the conductive support on which the undercoat layer is formed, followed by heating and drying at 100° C. for 10 minutes. As a result, a charge generation layer having a thickness of about 0.15 μm is formed.

Charge Transport Layer

Next, 2.6 parts by weight of benzidine compound represented by Formula (CT-1) and 3 parts by weight of polymer compound (viscosity average molecular weight: 79,000) having a repeating unit represented by Formula (B-1) are dissolved in 25 parts by weight of chlorobenzene to prepare a charge transport layer-forming coating solution. The obtained coating solution is dip-coated on the charge generation layer, followed by heating at 130° C. for 45 minutes. As a result, a charge transport layer having a thickness of about 20 μm is formed.

(CT-1)

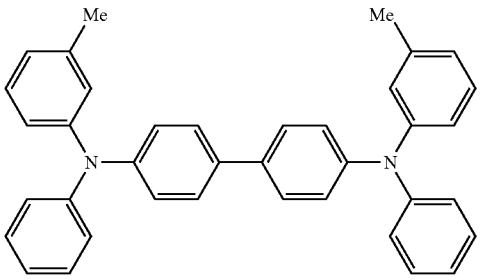

(B-1)

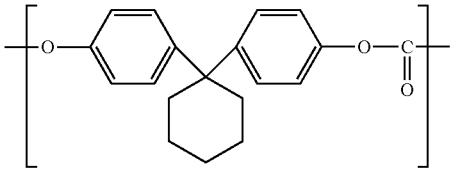

Examples 2 to 7 and Comparative Examples 1 and 2

Photoreceptors are prepared in the same preparation method as that of Example 1, except that the process conditions of the substrate (support), the Young's modulus, the purity of aluminum (Al), and the thickness of the substrate are changed as shown in Table 1 below.

The Young's modulus of the substrate is adjusted in the annealing and ironing processes. The thickness is adjusted by dies of the impact pressing process and in the ironing process.

Example 8

A conductive support is prepared with the following method. A slag, which is formed of JIS A1050-type alloy having an aluminum purity of 99.5% or higher and to which a lubricant is applied, is prepared. The slag is molded into a bottomed cylindrical pipe by impact pressing using a die (female) and a punch (male), followed by swaging and annealing at 150° C. for 1 hour. As a result, a cylindrical aluminum substrate having a diameter of 24 mm, a length of 251 mm, and a thickness of 0.5 mm is prepared. Then, the measurement is performed and a photoreceptor is prepared in the same manner as that of Example 1.

Example 9

A conductive support is prepared with the following method. A drawn pipe, which is formed of JIS A1050-type alloy having an aluminum purity of 99.5% or higher, is prepared, followed by surface cutting and annealing at 200° C. for 1 hour. As a result, a cylindrical aluminum substrate having a diameter of 24 mm, a length of 251 ram, and a thickness of 0.5 mm is prepared. Then, the measurement is performed and a photoreceptor is prepared in the same manner as that of Example 1.

Comparative Example 3

A conductive support is prepared with the following method. A slag, which is formed of JIS A1050-type alloy having an aluminum purity of 99.5% or higher and to which a lubricant is applied, is prepared. The slag is molded into a bottomed cylindrical pipe by impact pressing using a die (female) and a punch (male), followed by ironing for improving dimensional precision. As a result, a cylindrical aluminum substrate having a diameter of 24 mm, a length of 251 mm, and a thickness of 0.5 mm is prepared.

Comparative Example 4

A conductive support is prepared with the following method. A drawn pipe, which is formed of JIS A1050-type alloy having an aluminum purity of 99.5% or higher, is prepared. Then, an opening tip end thereof is treated, followed by swaging, surface cutting, and annealing at 200° C. for 1 hour. As a result, a cylindrical aluminum substrate having a diameter of 24 mm, a length of 251 mm, and a thickness of 0.5 mm is prepared. Then, the measurement is performed and a photoreceptor is prepared in the same manner as that of Example 1.

Evaluation

Falling Test

Each of the photoreceptors prepared in Examples and Comparative Examples is mounted to a process cartridge of a color image forming apparatus (manufactured by Fuji Xerox Co., Ltd., DocuPrint C1100). The photoreceptor is made to freely fall from a height of 2.0 m above the floor to crash to the floor.

After falling, the deformation amount of the substrate is measured using a RONDCOM 60A (manufactured by Tokyo Seimitsu Co., Ltd.). Whether there is deformation or not is examined and the substrate is evaluated based on the following criteria.

Deformation Amount

A: There is no problem

B: There is no problem in practice (circularity changed)

C: Deterioration in circularity is observed (to a level which affects image quality)

D: The peeling of a coating film is visually observed

The results are shown in Table 1 below.

TABLE 1

| | Configuration of Substrate (Support) | | | | | Evaluation |
|---|---|---|---|---|---|---|
| | Young's Modulus [MPa] | Al Purity [%] | Thickness [mm] | Process Method | Temperature/ Time of Annealing | Result Deformation Amount |
| Example 1 | 55000 | 99.5 | 0.50 | Impact Pressing + Ironing | None | A |
| Example 2 | 32000 | 99.5 | 0.50 | Impact Pressing + Ironing | 200° C./1.0 hr | A |
| Example 3 | 45000 | 99.5 | 0.50 | Impact Pressing + Ironing | 150° C./0.5 hr | A |
| Example 4 | 45000 | 99.0 | 0.50 | Impact Pressing + Ironing | 150° C./1.0 hr | B |
| Example 5 | 45000 | 99.5 | 0.30 | Impact Pressing + Ironing | None | A |
| Example 6 | 45000 | 99.5 | 0.90 | Impact Pressing + Ironing | 200° C./1.0 hr | A |
| Example 7 | 45000 | 99.5 | 0.28 | Impact Pressing + Ironing | None | B |
| Example 8 | 45000 | 99.5 | 0.50 | Impact Pressing + Swaging | 150° C./1.0 hr | A |
| Example 9 | 45000 | 99.5 | 0.50 | Drawing + Cutting | 200° C./1.0 hr | B |
| Comparative Example 1 | 60000 | 99.5 | 0.80 | Drawing + Cutting | None | C |
| Comparative Example 2 | 30000 | 99.5 | 0.50 | Drawing | 200° C./1.0 hr | D |
| Comparative Example 3 | 60000 | 99.5 | 0.90 | Impact Pressing | None | C |
| Comparative Example 4 | 60000 | 99.5 | 0.90 | Drawing + Swaging | 200° C./1.0 hr | D |

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A conductive support for an electrophotographic photoreceptor, the conductive support consisting of:

aluminum or an alloy of aluminum with one or more of Si, Fe, Cu, Mn, Mg, Cr, Zn, and Ti, wherein the conductive support has a Young's modulus of from 32,000 MPa to 55,000 MPa.

2. The conductive support according to claim 1, wherein the Young's modulus is from 36,000 MPa to 51,000 MPa.

3. The conductive support according to claim 1, wherein a content of the aluminum is greater than or equal to 99.5%.

4. The conductive support according to claim 1, wherein a content of the aluminum is greater than or equal to 99.7%.

5. The conductive support according to claim 1, wherein the conductive support has a thickness of from 0.3 mm to 0.9 mm.

6. The conductive support according to claim 1, wherein the conductive support has a thickness of from 0.4 mm to 0.6 mm.

7. An electrophotographic photoreceptor comprising:

the conductive support according to claim 1; and a photosensitive layer that is arranged on the conductive support.

8. The electrophotographic photoreceptor according to claim 7, wherein the conductive support has a Young's modulus of from 36,000 MPa to 51,000 MPa.

9. The electrophotographic photoreceptor according to claim 7, wherein a content of the aluminum in the conductive support is greater than or equal to 99.5%.

10. The electrophotographic photoreceptor according to claim 7, wherein a content of the aluminum in the conductive support is greater than or equal to 99.7%.

11. The electrophotographic photoreceptor according to claim 7, wherein the conductive support has a thickness of from 0.3 mm to 0.9 mm.

12. The electrophotographic photoreceptor according to claim 7, wherein the conductive support has a thickness of from 0.4 mm to 0.6 mm.

13. An image forming apparatus comprising:

the electrophotographic photoreceptor according to claim 7;

a charging unit that charges a surface of the electrophotographic photoreceptor;

an electrostatic latent image forming unit that forms an electrostatic latent image on a charged surface of the electrophotographic photoreceptor;

a developing unit that develops the electrostatic latent image, formed on the surface of the electrophotographic photoreceptor, using a developer containing toner to form a toner image; and a transfer unit that transfers the toner image, formed on the surface of the electrophotographic photoreceptor, onto a recording medium.

14. A process cartridge, which is detachable from an image forming apparatus, comprising the electrophotographic photoreceptor according to claim 7.

15. The conductive support according to claim 1, wherein the conductive support has a cylindrical shape and a thickness of from 0.3 mm to 0.6 mm.

16. The conductive support according to claim 1, wherein the conductive support has a surface roughness of from 0.04 mm to 0.5 mm.

* * * * *